US010006206B2

(12) United States Patent
Traub

(10) Patent No.: US 10,006,206 B2
(45) Date of Patent: Jun. 26, 2018

(54) JOINT ASSEMBLY FOR USE IN A RETRACTABLE AWNING

(71) Applicant: Rainier Industries, Ltd., Tukwila, WA (US)

(72) Inventor: David King Traub, Renton, WA (US)

(73) Assignee: Rainier Industries, Ltd., Tukwila, WA (US)

( * ) Notice: Subject to any disclaimer, the term of this patent is extended or adjusted under 35 U.S.C. 154(b) by 93 days.

(21) Appl. No.: 15/295,957

(22) Filed: Oct. 17, 2016

(65) Prior Publication Data

US 2018/0106047 A1 Apr. 19, 2018

(51) Int. Cl.
*E04F 10/06* (2006.01)

(52) U.S. Cl.
CPC ..... *E04F 10/0614* (2013.01); *E04F 10/0633* (2013.01); *E04F 10/0692* (2013.01)

(58) Field of Classification Search
CPC ..... E04F 10/0614; E04F 10/0666; E04F 10/0651; E04F 10/0648; E04F 10/0618; E04F 10/0688; E05D 5/10
USPC ..... 160/70, 79
See application file for complete search history.

(56) References Cited

U.S. PATENT DOCUMENTS 6,363,664 B1 * 4/2002 Brutsaert ..... E04F 10/0618 135/117
6,557,612 B2 * 5/2003 Voss ..... E04F 10/0618 160/70
6,732,018 B2 * 5/2004 Osinga ..... E04F 10/0659 160/1
6,957,679 B2 * 10/2005 Powell ..... E04F 10/06 160/263
7,451,797 B2 * 11/2008 Llagostera Forns ..... E04F 10/0611 160/70
8,042,596 B2 * 10/2011 Llagostera Forns ..... E04F 10/0622 160/70
8,113,260 B2 2/2012 Llagostera Forns
8,141,613 B2 * 3/2012 Brutsaert ..... E04F 10/064 160/22

(Continued)

OTHER PUBLICATIONS

R-90, URL <http://www.batusa.us/en/prodotti/dettaglio/australia-147.html>(Web page cached on Jan. 6, 2015).

(Continued)

*Primary Examiner* — Beth A Stephan
(74) *Attorney, Agent, or Firm* — Patrick J. S. Inouye; Leonid Kisselev

(57) ABSTRACT

An awning arm is provided in which internal components are concealed and in which tension is adjustable. The arm includes an elbow that includes an outer knuckle that includes a top tang and a bottom tang, the tangs rotatably engaged to a circular encasement of an inner knuckle via a plurality of bushings. Two hubs are concealed by the encasement and the tangs, the hubs secured within the two tangs. A webbing is secured within the hubs, a pull upon the webbing urging the rotation of the hubs and consequently the outer knuckle and the elbow as a whole. Arm extrusions are attached to the outer and inner knuckles, with the rotation of the elbow causing the bending and straightening of the arm. Components that prevent the arm from overextending are concealed within the elbow.

20 Claims, 15 Drawing Sheets

(56) References Cited

U.S. PATENT DOCUMENTS

| | | | | |
|---|---|---|---|---|
| 8,316,910 | B2 * | 11/2012 | Popa | E04F 10/0618 160/46 |
| 2001/0027846 | A1 * | 10/2001 | Osinga | E04F 10/0659 160/70 |
| 2003/0106649 | A1 * | 6/2003 | Wessels | E04F 10/0611 160/70 |
| 2008/0308238 | A1 * | 12/2008 | Ito | E04F 10/0611 160/67 |

OTHER PUBLICATIONS

Sunsetter Awnings by Lanier Aluminum Products, URL <http://sunsetternorthgeorgia.com/products/motorized-motorized-xl/> (Web page cached on Aug. 6, 2016).

* cited by examiner

16

36

37

82

82

82

104

JOINT ASSEMBLY FOR USE IN A RETRACTABLE AWNING

FIELD

This application relates in general to tools for mechanical joints, and in particular, to a joint assembly for use in a retractable awning.

BACKGROUND

Retractable awnings provide a person the flexibility of being able to control the reach of light as well as of atmospheric precipitations over an area adjacent to a building, such as the user's home or a commercial building, without having to perform labor-intensive activities such as setting up a tent. Such awnings generally include a canvas, such as fabric, stretched over a structure that attaches to the building and including at least two mechanical arms that include a tensioned spring and whose bending and straightening can be controlled by the user, increasing and decreasing the area covered by the fabric. When the user desires to limit the reach of light or precipitation over the area, the awning is extended to cover the desired area via a straightening of the arms. When the coverage by the canvas is no longer desired, the awning can be retracted via a bending of the arms, making the desired area once again accessible to light, such as sunlight, and precipitation. As retractable awnings are commonly motorized, a user can often accomplish the extension and retraction of an awning with a push of a button.

Existing retractable awnings have a variety of drawbacks that limit their functionality and attractiveness to a user. For example, most manufactured arms have a tension in the spring that differs from the tension in other arms. If two arms with mismatched tension are included in the same awning, the awning may not properly extend or retract. Thus, awning manufacturers must either match the arms for an awning at the factory or accept the possibility that their awning may not properly deploy.

Further, as awnings are attached to the outside of buildings, the mechanical components of the awnings, such as the arms, are constantly and continuously exposed to the elements, such as precipitation and wind. Such exposure can lead to the degradation of the mechanical components due to corrosion and other environmental impact, causing a need to replace the awning. A particularly vulnerable point of such awnings can be an elbow, a joint of the mechanical arm at which the arm bends. If degraded, the arms may be no longer capable of bending, and the awning will no longer be retractable, losing the awning's usefulness. This degradation is especially significant due to commercially available awnings not providing adequate protection of the internal components of the arms. For example, the awnings distributed by BAT USA Group of Manhattan, N.Y. include arms with elbows whose internal components are visibly exposed to the outside world. Such exposure allows moisture and other elements to interact with the internal elbow components, hastening their degradation. Other currently available commercial designs suffer from similar drawback. Further, the exposure of the internal components of the elbows, such as cables used in the elbows, may be aesthetically unattractive to the user. Such aesthetic repulsion may increase as the internal components become visible corroded.

Likewise, additional components of currently-produced arms have functional and aesthetic drawbacks. For example, an overextension of the arms could cause a deformation of the shape of an awning, rendering the awning useless. To keep the arms from overextending, existing awnings, such as those distributed by BAT USA Group, employ external blocks that limit how far the elbow of the arm can rotate, thus preventing the overextension of the arm. Due to these blocks being external, they are exposed to potential damage, creating another vulnerability in the arm. Some users may also find such blocks aesthetically unappealing.

Finally, currently available arms of retractable awnings are generally unitary structures that cannot be easily disassembled in the field. When one component of such arms becomes degraded, the entire arm, if not the entire retractable awning, needs to be replaced, or returned to the manufacturer. Such replacement or return increases the cost of owning a retractable awnings as well limiting their lifespan.

Accordingly, there is a need for an easily-serviceable and adjustable retractable awning arm whose internal components are not easily accessible to the elements and in which tension can be regulated.

SUMMARY

An awning arm is provided in which internal components are concealed and in which tension is adjustable. The arm includes an elbow that includes an outer knuckle that includes a top tang and a bottom tang, the tangs rotatably engaged to a circular encasement of an inner knuckle via a plurality of bushings. Two hubs are concealed by the encasement and the tangs, the hubs secured within the two tangs. A webbing is secured within the hubs, a pull upon the webbing urging the rotation of the hubs and consequently the outer knuckle and the elbow as a whole. Arm extrusions are attached to the outer and inner knuckles, with the rotation of the elbow causing the bending and straightening of the arm.

The concealment of the webbing and other internal components of the arm increases the protection of these components from the elements while increasing the aesthetic attractiveness of the arm at the same time. In addition to the webbing, the components of the elbow that prevent the arm from overextending are concealed within the elbow. Further, the disclosed arm can be serviced in the field and individual components can be provided replaced separately, without having to replace the entire arm.

The disclosed arm provides an easy way to adjust the tension within the arm, allowing for a way to equalize tensions in awning arms that are initially mismatched. A tension bolt is inserted within a shoulder of the arm. The bolt is also screwed into a tension hook within the shoulder. The tension in the arm is provided by a tensioned spring one end of which is attached to the tension hook and the other end of which is attached to the webbing. The bolt can be screwed in further into the tension hook to bring the hook away from the webbing and thus increase the tension within the spring. Alternatively, the tension hook can be moved closer to the webbing by screwing the tension bolt more out of the hook, decreasing the tension in the spring.

In one embodiment, a joint assembly for use in a retractable awning is provided. The assembly includes: an inner knuckle including a circular encasement and an inner knuckle sleeve one end of which is formed on a portion of the circular encasement, the portion of the encasement defining a slot; an outer knuckle including a support structure, an outer knuckle sleeve one end of which is formed on one side of the support structure, a top tang including a circular bore and that is formed on a side of the support structure opposite to the side on which the outer knuckle sleeve is formed, and a bottom tang including an indentation and that is formed on the opposite side of the support structure, the top tang rotatably engaged to a top portion of the circular encasement, the bottom tang rotatably engaged to a bottom portion of the circular encasement, the outer knuckle rotatable in two directions along the top portion of the encasement and the bottom portion of the encasement; a bottom hub partially within the circular encasement and including an inner surface and an outer surface, the outer surface including an end inserted into the bottom tang indentation, the inner surface including a counterbore formed at another end of the bottom hub and a passage from the counterbore to the end of the bottom hub, the bottom hub further defining a slot adjacent to at least a portion of the counterbore; a top hub partially within the circular encasement, the top hub including a bottom portion mounted within the bottom hub counterbore and a top portion mounted within the circular bore, the top hub further including a passage that is adjacent to the bottom hub passage and defining a slot that is adjacent to a portion of the top hub passage and to the bottom hub slot; a pin inserted through at least a portion of the top hub passage and at least a portion of the bottom hub passage; and a webbing looped around at least a portion of the pin and passed through the bottom hub slot, the top hub slot, and the inner knuckle slot into the inner knuckle sleeve, the webbing adapted to wrap around at least a portion of the outer surface of the bottom hub when the outer knuckle rotates in one of the directions, the webbing urging the outer knuckle to rotate into another of the directions upon an application of a pulling force upon the webbing.

In a further embodiment, a retractable awning arm is provided. The arm includes a shoulder including a shoulder extrusion through which a bolt is inserted, the shoulder further including a tension hook mounted upon the bolt; a upper arm extrusion including an upper arm sleeve into one end of which the shoulder extrusion is inserted; a tensioned spring within the upper arm sleeve that is securely attached to the tension hook; a lower arm member; a wrist assembly securely attached to the lower arm member; and an elbow assembly. The elbow assembly includes: an inner knuckle including a circular encasement and an inner knuckle sleeve including one end formed on a portion of the circular encasement and another end securely inserted within the lower arm sleeve, the portion of the encasement defining a slot; an outer knuckle including a support structure, an outer knuckle sleeve one end of which is formed on one side of the support structure, a top tang including a circular bore and that is formed on a side of the support structure opposite to the side on which the outer knuckle sleeve is formed, and a bottom tang including an indentation and that is formed on the opposite side of the support structure, the top tang rotatably engaged to a top portion of the circular encasement, the bottom tang rotatably engaged to a bottom portion of the circular encasement, the outer knuckle rotatable in two directions along the top portion of the encasement and the bottom portion of the encasement, the rotation of the outer knuckle causing a rotation of the lower arm; a bottom hub partially within the circular encasement and including an inner surface and an outer surface, the outer surface including an end inserted into the bottom tang indentation, the inner surface including a counterbore formed at another end of the bottom hub and a passage from the counterbore to the end of the bottom hub, the bottom hub further defining a slot adjacent to at least a portion of the counterbore; a top hub partially within the circular encasement, the top hub including a bottom portion securely mounted within the bottom hub counterbore and a top portion mounted within the circular bore, the top hub further including a passage that is adjacent to the bottom hub passage and a defining slot that is adjacent to a portion of the top hub passage and to the bottom hub slot; a pin inserted through at least a portion of the top hub passage and at least a portion of the bottom hub passage; a webbing looped around at least a portion of the pin and passed through the bottom hub slot, the top hub slot, the inner knuckle, the inner knuckle slot, the inner knuckle sleeve into the inner upper arm sleeve and coupled to the spring, the webbing adapted to wrap around at least a portion of the outer surface of the bottom hub when the outer knuckle rotates in one of the directions, the tensioned spring adapted to urge the webbing to rotate into another of the directions.

In a still further embodiment, a retractable awning is provided. The awning includes a fabric roll including fabric partially rolled onto a rotatable roller tube; a front bar to which a portion of the fabric is attached; a torsion bar attached to the roller tube; and two arms attached to the torsion bar and the front bar, the arms bendable upon a rotation of the fabric roll pulling the front bar towards the fabric roll. Each of the arms includes: a shoulder including a shoulder extrusion through which a bolt is inserted, the shoulder further including a tension hook mounted upon the bolt; an upper arm extrusion including an upper arm sleeve into one end of which the shoulder extrusion is inserted; a tensioned spring within the upper arm sleeve that is securely attached to the tension hook; a lower arm member; a wrist assembly including an end securely attached to the lower arm member and another end attached to the front bar; and an elbow assembly. The elbow assembly includes: an inner knuckle including a circular encasement and an inner knuckle sleeve including one end formed on a portion of the circular encasement and another end securely inserted within the lower arm sleeve, the portion of the encasement defining a slot; an outer knuckle including a support structure, an outer knuckle sleeve one end of which is formed on one side of the support structure, a top tang including a circular bore and that is formed on a side of the support structure opposite to the side on which the outer knuckle sleeve is formed, and a bottom tang including an indentation and that is formed on the opposite side of the support structure, the top tang rotatably engaged to a top portion of the circular encasement, the bottom tang rotatably engaged to a bottom portion of the circular encasement, the outer knuckle rotatable in two directions along the top portion of the encasement and the bottom portion of the encasement, the rotation of the outer knuckle causing a rotation of the lower arm; a bottom hub partially within the circular encasement and including an inner surface and an outer surface, the outer surface including an end inserted into the bottom tang indentation, the inner surface including a counterbore formed at another end of the bottom hub and a passage from the counterbore to the end of the bottom hub, the bottom hub further defining a slot adjacent to at least a portion of the counterbore; a top hub partially within the circular encasement, the top hub including a bottom portion securely mounted within the bottom hub counterbore and a top portion mounted within the circular bore, the top hub further including a passage that is adjacent to the bottom hub passage and a slot that is adjacent to a portion of the top hub passage and to the bottom hub slot; a pin inserted through at least a portion of the top hub passage and at least a portion of the bottom hub passage; a webbing looped around at least a portion of the pin and passed through the bottom hub slot, the top hub slot, the inner knuckle, the inner knuckle slot, the inner knuckle sleeve into the inner upper arm sleeve and coupled to the spring, the webbing adapted to wrap around at least a portion of the outer surface of the bottom hub when the outer knuckle rotates in one of the directions during the bending of the arm, the tensioned spring adapted to urge the webbing to rotate into another of the directions and to urge a straightening of the arm.

Still other embodiments of the present invention will become readily apparent to those skilled in the art from the following detailed description, wherein is described embodiments of the invention by way of illustrating the best mode contemplated for carrying out the invention. As will be realized, the invention is capable of other and different embodiments and its several details are capable of modifications in various obvious respects, all without departing from the spirit and the scope of the present invention. Accordingly, the drawings and detailed description are to be regarded as illustrative in nature and not as restrictive.

DETAILED DESCRIPTION

Figure 1:
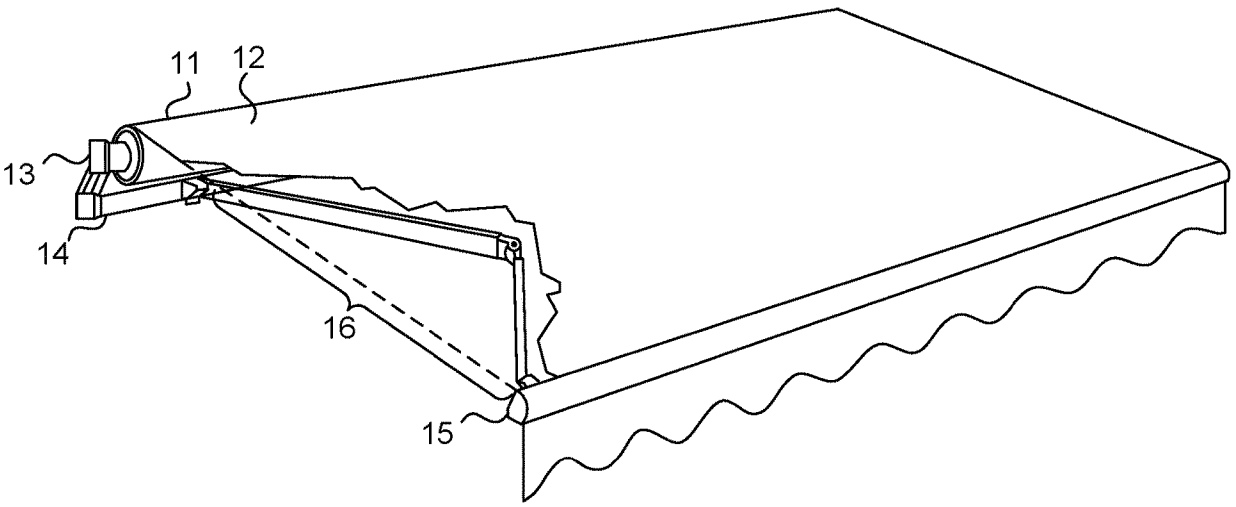
FIG. 1 is a perspective view of a retractable awning in accordance with one embodiment.

FIG. 1 is a perspective view of a retractable awning 10 in accordance with one embodiment. The awning 10 includes a fabric roll 11, which includes a fabric 12 rolled onto a roller tube 13. The tube 13 is connected to a torsion bar 14, which transfers the force generated by the awning due to gravity to a building (not shown) to which the torsion bar 14 can be attached. The fabric 12 from the roll 11 is also attached to a front bar 15 that forms the front edge of the awning 10. At least two arms 16 connect the torsion bar 14 to the front bar 15. The arms 16 are bendable at elbows 17. Upon a rotation of the roller tube 13 that pulls the fabric 12 attached to the front bar 15 towards the roller tube 13, the bending of the arms 16 at the elbows 17 allows the front bar 15 to move towards the torsion bar 14 and the roller tube 13 and for the awning 10 to be retracted. The straightening of the arms 16 at the elbows 17 brings the front bar 15 away from the torsion bar 14, causing the rotation of the roller tube 13 in the direction opposite to the direction that caused the retraction, thus allowing the awning to return to the extended position. The rotation of the roller tube 13 can be done manually by a user or by a motor (not shown) under the control of the user.

Figure 2:
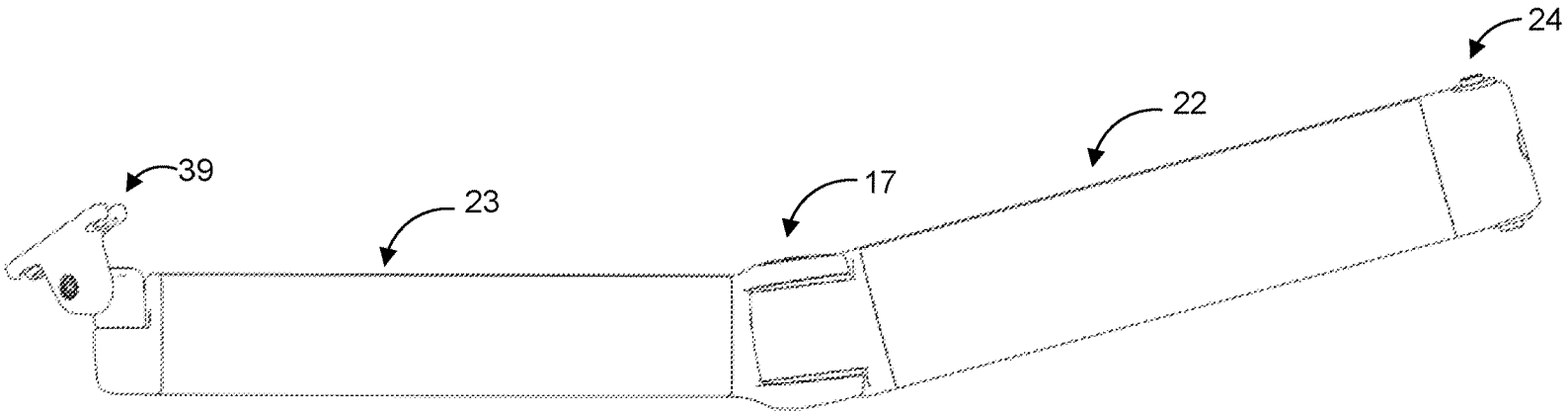
FIG. 2 is a perspective view of the arm of the awning of FIG. 1 in accordance with one embodiment.

The bending and straightening of the arm 16 allows for extension and retraction of the awning 10. FIG. 2 is a perspective view of the arm 16 of the awning 10 of FIG. 1 in accordance with one embodiment. The arm 16 includes a shoulder 21, an upper arm extrusion 22, a lower arm extrusion 23, an elbow 17, and a wrist assembly 24. While the arm shown is a right arm of the awning with reference to FIG. 2 is a right arm of the awning, a left arm of the awning would be a mirror image of the right arm. Other views of the right arm and the left arm can be seen in commonly-assigned U.S. Design Patent application, entitled "Retractable Awning Arm," Ser. No. 29/581,261, filed Oct. 17, 2016, the disclosure of which is incorporated by reference. The shoulder 21 attaches to the torsion bar 14 and the wrist assembly 24 attaches to the front bar 15.

Figure 3:
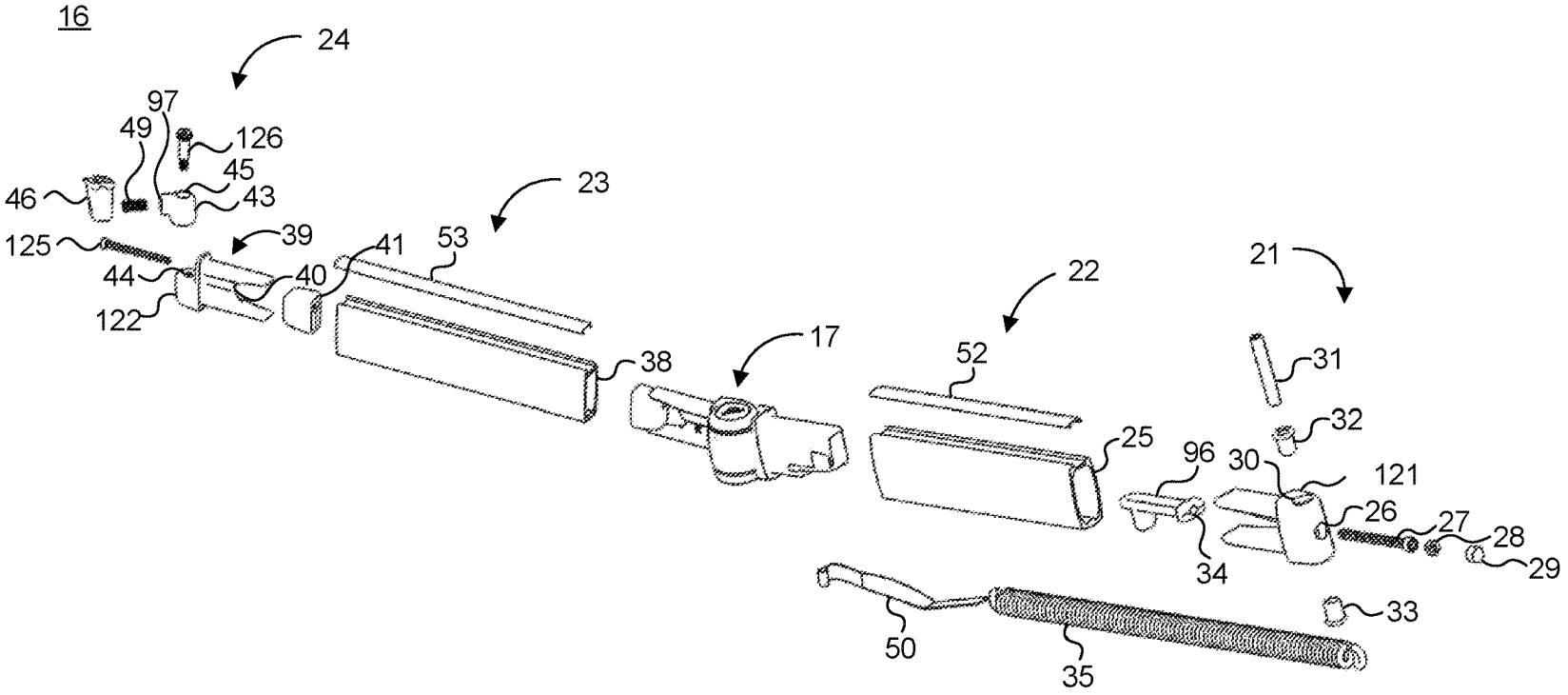
FIG. 3 is a diagram showing components of the arm of FIG. 2 disassembled in accordance with one embodiment.
Figure 4:
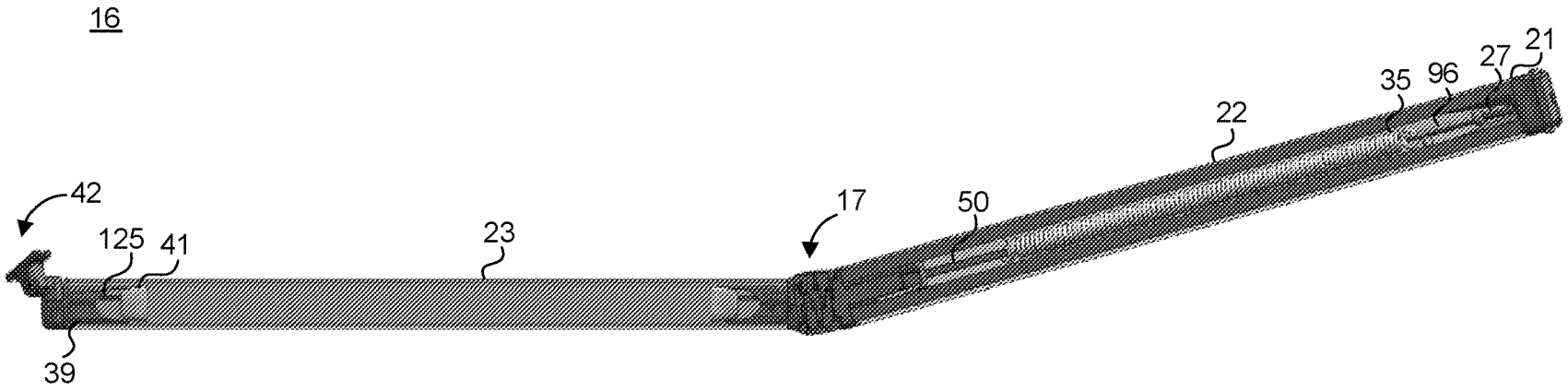
FIG. 4 is a diagram showing a cross-section of the arm of FIG. 2 in accordance with one embodiment.

Additional details regarding the arm can be seen with reference to FIGS. 3 and 4. FIG. 3 is a diagram showing components of the arm 16 of FIG. 2 disassembled in accordance with one embodiment. FIG. 4 is a diagram showing a cross-section of the arm 16 of FIG. 2 in accordance with one embodiment.

As can be seen with reference to FIG. 3, the upper arm extrusion 22 includes a sleeve 25 into which one end of the shoulder 21 can be inserted, as can be seen with reference to FIG. 4. The shoulder 21 in turn includes a shoulder extrusion 121, which includes a passage 26 into which a threaded bolt 27 is inserted and which can be used to control tension within the arm 16 as further described below. The tension bolt 27 is secured within the passage 26 using a tension lock 28. The tension lock 28 prevents the bolt from unscrewing from the hook 96. The shoulder extrusion 121 further includes a passage 30 into which is inserted a pin 31 secured within the passage by bushings 32 and 33 that are inserted into two ends of the passage 30.

The tension bolt 27 threads into a threaded bore 34 of a tension hook 96, thus attaching the hook 96 onto the bolt 27. The tension lock 28 has a hexagonal profile that fits into the bolt 27 and that prevents the bolt 27 from spinning and unscrewing from the tension hook 96. The passage 30 is perpendicular to the passage 26, and when the pin 31 is secured within the passage 30 by the bushings 32 and 33, the pin 31 blocks the tension lock 28 from escaping from the passage 26. A shoulder plug 29 is also inserted into the passage 26, concealing the pin 31 and other internal components from view from the passage 26. The pin 31 extends through and beyond the bushings 32 and 33, with the portions of the pin 31 extending beyond at least beyond the bushing 32 being used for attachment of the arm 16 to the torsion bar 14 and rotation of the arm 16 on the torsion bar 14.

As can be seen with reference to FIGS. 3 a 4, a tensioned spring 35 attaches to the hook 96. The spring 35 further attaches to a webbing 50 that is a part of the elbow 17 when the arm 16 is fully assembled. For purposes of clarity, the webbing 50 is shown separately from the rest of the elbow 17 with reference to FIG. 3. Further, the webbing 50 shown with reference to FIG. 3 has the same shape as when a part of the fully assembled arm 16; other shapes of the webbing 50 when the webbing 50 is outside of the arm 21 are possible.

The distance between the hook 96 to which the spring 35 is attached on one end and the webbing 50 to which the spring is attached on the other end influences the amount of tension that the spring 35 is under, which in turn influences the amount of a pulling force necessary to bend the arm 16. The distance, and consequently, the tension present in the arm 16, can be adjusted by changing the depth with which the bolt 27 is threaded into the hook 96. As the bolt 27 is screwed into the hook 96 further, the hook 96 is drawn closer to the tension lock 28 and further away from the webbing 50, thus increasing the tension in the spring 35. In the same manner, as the bolt 27 is screwed out of the hook 96, the hook 96 moves towards the webbing 50 and the tension in the spring decreases. Thus, the shoulder 21 provides a simple way to adjust the tension within the arms 16, allowing to easily correct any complications caused by arms 16 with mismatched tension. To adjust the tension in an arm 16 that has already been installed, one would have to disconnect the arm from the torsion bar 14, remove the plug 29, the pin 31 (and consequently the bushings 32 and 33), and the tension look 28. Once these components are removed, a user can adjust the tension in the arm by turning the bolt 27 in one direction or another, screwing the bolt 27 in or out of the hook 96.

The elbow 17 connects the upper arm extrusion 22 and the lower arm extrusion 23. As further described below, the elbow 17 includes an inner knuckle 36 and an outer knuckle 37. The inner knuckle 36 is attached to the upper arm extrusion 22, such as through being inserted into the end of the sleeve 25 opposite to the end into which the shoulder extrusion 121 is inserted. The outer knuckle 37 of the elbow 17 is in turn attached to the lower arm extrusion 23. Thus, the lower arm extrusion 23 includes a sleeve 38 into which the outer knuckle 37 is inserted. A wrist extrusion 39 included in the wrist assembly 24 is inserted into the end of the sleeve 38 opposite to the end in which in which the outer knuckle 37 is inserted.

The wrist extrusion 39 includes a sleeve 40 into which a wedge 41 is inserted and secured by a bolt 125 that passes through an opening (not shown) within the wrist sleeve 40. The insertion of the wedge 41 widens the sleeve 40 enough to securely insert within the sleeve 38. The sleeve 40 is attached to a support structure 122 on which a hook 42, shown with reference to FIG. 4, that is used for attachment to the front bar 15 is located. The parts forming the hook 42 are shown with reference to FIG. 3. The hook 42 includes a wrist swivel 43 that is attached to an opening 44 formed within the support structure 122 via a bolt 126 inserted through a bore 45 within the swivel 43 and the cavity 44. The hook 42 further includes an attachment structure 46 that is secured to the swivel 43 using a set screw 49 that is inserted into an opening 97 within the swivel 43 and an opening within the attachment structure 46. Other kinds of hooks 42 are also possible.

As can be seen with reference in FIG. 4 and as further described below, the spring 35 attached to the hook 96 integrated within the shoulder 21 is also attached to a webbing 50 located within the inner knuckle 36. As further described below, the outer knuckle 37 is rotatably engaged to the inner knuckle 36, with the rotation of the outer knuckle 37 with respect to the inner knuckle 36 resulting in a rotation of the elbow 17 as a whole and bending and straightening of the arm 16. The pull of the spring 35 upon the webbing 50 urges a straightening of the elbow 36. To overcome the urging and to cause the bending of the elbow, the pull of the fabric 12 must be stronger than the pull caused by the spring 35 in the opposite direction. The spring 35 can be attached to the webbing 50 in a variety of ways. For example, the webbing 50 can include an opening into which a hook formed by the spring 35 can insert. Alternatively, the end of the webbing 50 that attaches to the spring 50 can form a loop into which the hook formed by the spring 35 can insert. Other ways for the webbing to attach to the spring 35 are possible.

Other elements of the arm 16 are also possible. For example, plastic covers 52 and 53 could be attached to the sleeve 25 and the sleeve 38 respectively, being parts of the upper arm extrusion 22 and the lower arm extrusion 22 respectively. Other components of the arm 16 are also possible.

Figure 5:
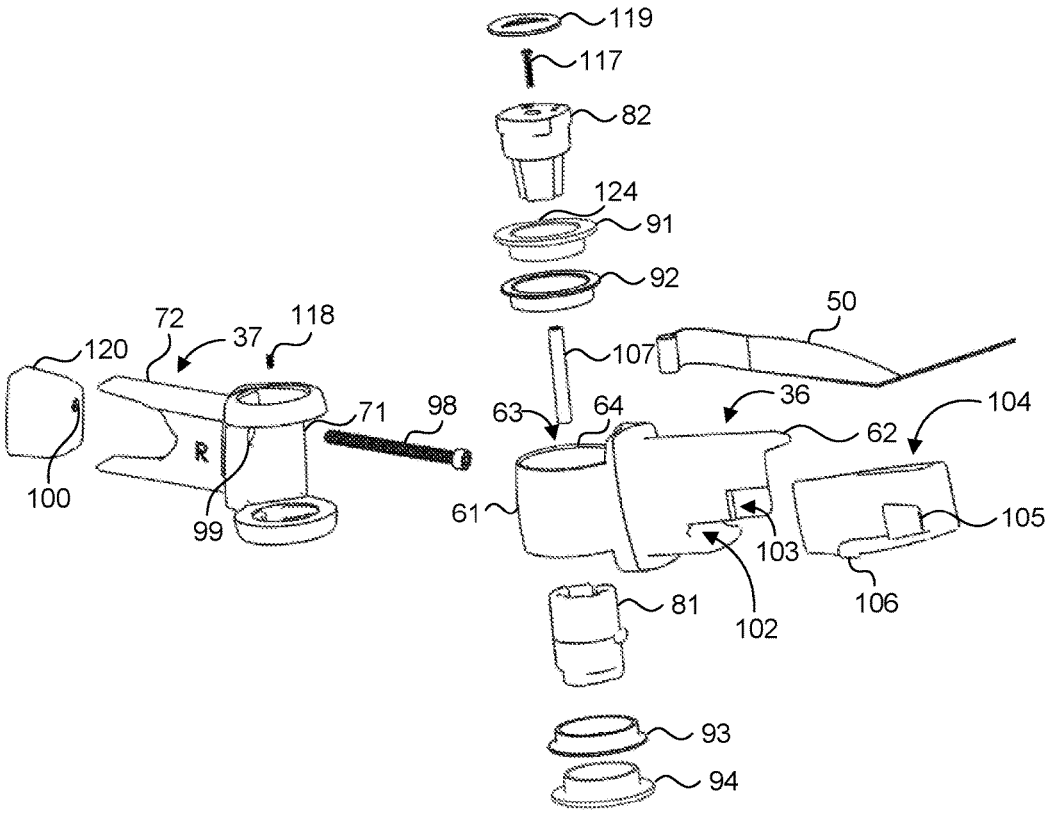
FIG. 5 is a diagram showing a disassembled elbow of the arm of FIG. 2 in accordance with one embodiment.

When the arm 16 is fully assembled, the webbing 50 is not visible from the outside of the arm 16, protecting the webbing 50 and other internal components of the elbow from the elements. FIG. 5 is a diagram showing a disassembled elbow 17 of the arm 16 of FIG. 2 in accordance with one embodiment. The elbow 17 includes the inner knuckle 36 that includes a circular encasement 61 and a sleeve 62 one end of which is formed on the encasement 61. The encasement 61 surround a hollow space 63 into which, as described further below, other components of the elbow 17 can be placed. The encasement 61 further defines a top counterbore 64 defined at a top surface of the encasement 61.

Figure 6A:
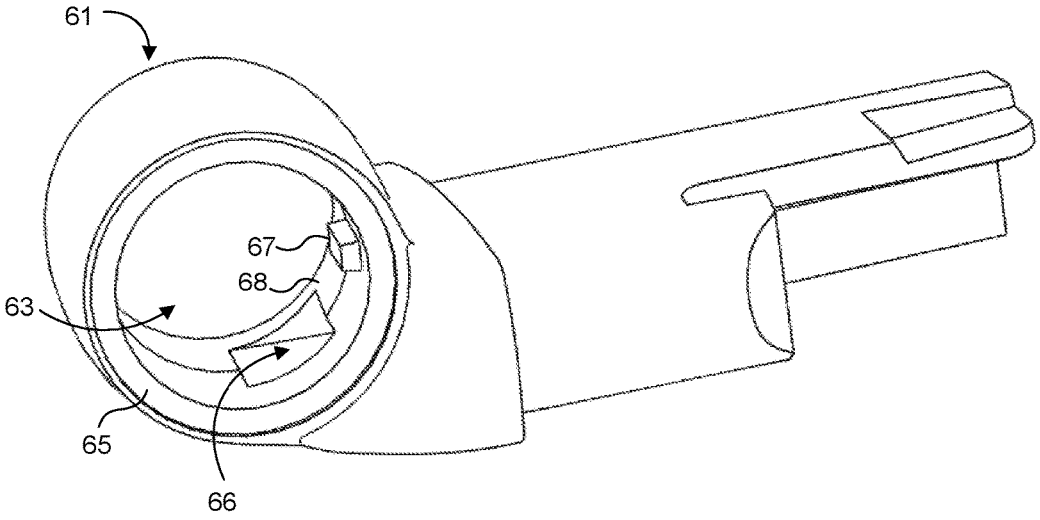
FIG. 6A is an alternative view of the inner knuckle of FIG. 5 in accordance with one embodiment.

FIG. 6A is an alternative view of the inner knuckle 36 of FIG. 5 in accordance with one embodiment. As can be seen with reference to FIG. 6A, the encasement 61 further includes a bottom counterbore 65 defined at a bottom surface of the encasement 61. The encasement 61 further defines a slot 66 within the portion of the encasement 61 on which the end of the sleeve 62 is formed. As further described below, the webbing 50 can pass through the slot 66 into the sleeve 62. The inner surface 68 of the encasement 61 further defines a protrusion 67 that limits the rotation of the elbow 17, as further described below.

Returning to FIG. 5, as mentioned above, the elbow 17 further includes an outer knuckle 37 that is rotatably engaged to the inner knuckle 36. In particular, the outer knuckle 37 includes a support structure 71 and a sleeve 72 one end of which is formed on one side of the support structure 71. The outer knuckle 37 further includes a top tang 73 that defines a circular bore 74 and that is formed on a side of the support structure 71 opposite to the side on which the sleeve 72 is formed. The outer knuckle 37 further includes a bottom tang 75 that includes an indentation 76 and that is formed on the opposite side of the support structure 72. The surfaces of the top tang 73 and the bottom tang 75 that are facing each other are not parallel and include a draft. In one embodiment, the draft can be a two degree draft. In a further embodiment, a different degree of draft is possible.

Figure 6B:
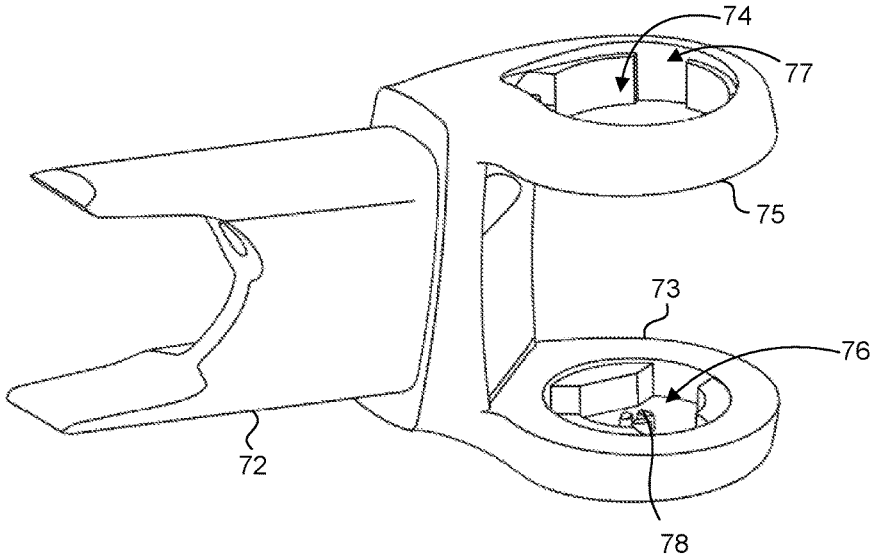
FIG. 6B is an alternative view of the outer knuckle of FIG. 5 in accordance with one embodiment.

FIG. 6B is an alternative view of the outer knuckle 37 of FIG. 5 in accordance with one embodiment. As can be seen with reference to FIG. 6B, the circular bore 74 includes a plurality of grooves 77. As can be also seen with reference to FIG. 6B, an attachment structure 78 is placed within the indentation 76. As described further below, a set screw 118 can insert into the attachment structure 78.

The top tang 73 and the bottom tang 75 are rotatably engaged to the top portion of the circular encasement 61 that defines the counterbore 64 and the bottom portion of the circular encasement 61 that defines the counterbore 65, respectively. The rotatable engagement is achieved using a set of bushings 91-94, as further described below.

Returning to FIG. 5, a wedge 120 can be inserted into the sleeve 72 of the outer knuckle 37 to make the sleeve 72 wider and to increase the tightness of the fit between the sleeve 72 and the lower arm extrusion sleeve 38, removing the need to use additional fasteners such as glue to secure the sleeve 72 within the sleeve 38. The support structure 72 includes a passage 99 leading into the sleeve 72. A bolt 98 can be inserted into the passage 99 and into the sleeve 72. The wedge 120 includes a threaded opening 100 and the bolt 98 screws into the opening 100, securing the wedge 120 within the sleeve 72.

Figure 7A:
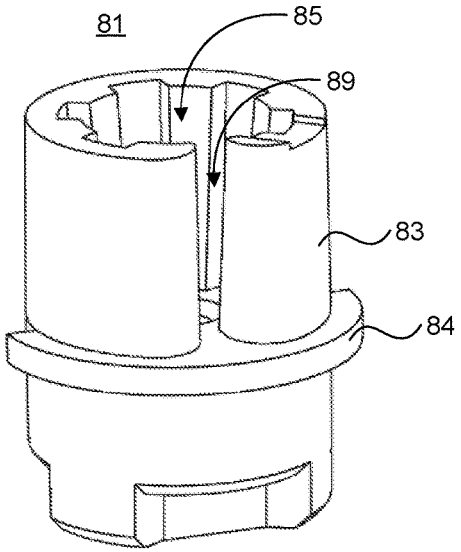
FIGS. 7A-7C show several views of the bottom hub of FIG. 5 in accordance with one embodiment.
Figure 7B:
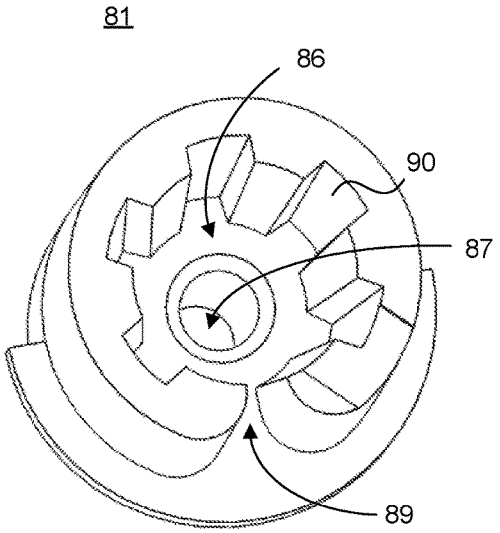
Figure 7C:
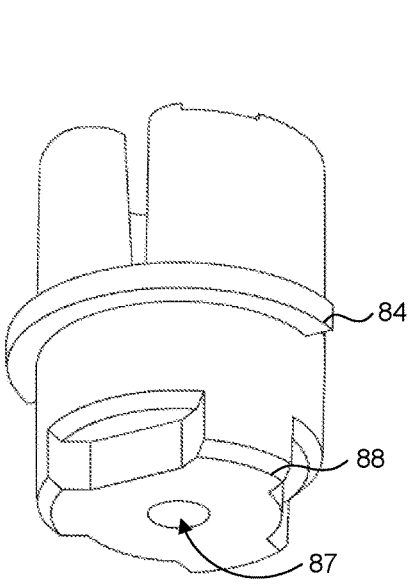
Figure 8A:
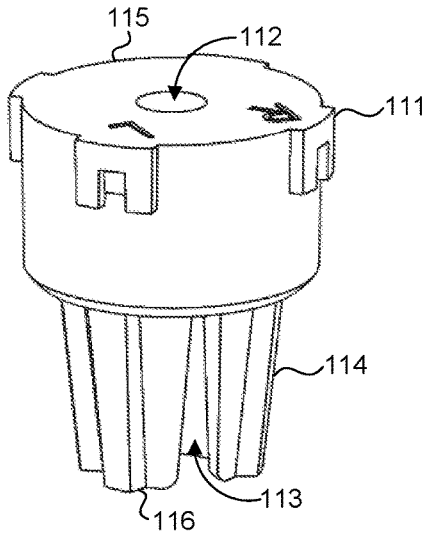
FIGS. 8A-8C show several views of the top hub of FIG. 5 in accordance with one embodiment.
Figure 8B:
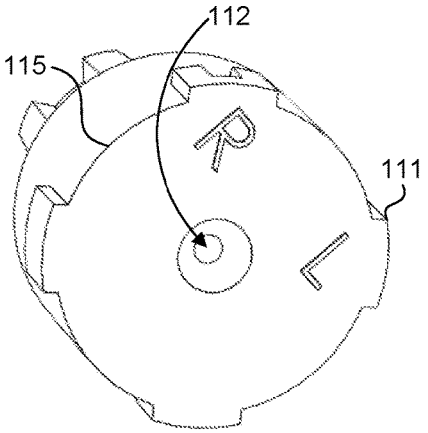
Figure 8C:
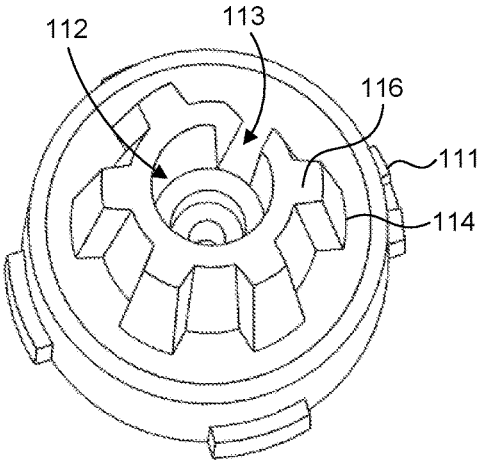

The elbow 17 further includes two coupled hubs that are both partially placed within the hollow space 63: a bottom hub 81 and a top hub 82. FIGS. 7A-7C show several views of the bottom hub 81 of FIG. 5 in accordance with one embodiment. FIGS. 8A-8C show several views of the top hub 82 of FIG. 5 in accordance with one embodiment. As can be seen with reference to FIG. 7A, the bottom hub 81 includes an outer surface 83 on which is a flange 84 is formed. When the elbow 17 is assembled, the flange 84 is coplanar with the protrusion 67 of the inner surface 68 of the circular encasement 61. During the rotation of the elbow 17, a pressing of the flange 84 against the protrusion 67 blocks the rotation of the elbow 17 in a particular direction, as further described below. The flange 84 and the protrusion 67 prevent the overextension of the arms 16 while concealed from a user's view during use. Such concealment improves the aesthetic appearance of the arm 16 as well as protects these components of the arm from the elements.

The inner surface 85 of the bottom hub 81 forms a counterbore 86. A passage 87 leads from the counterbore 86 to an end of the bottom hub opposite to the end of the bottom hub shown in FIG. 7C. The end of the bottom hub 81 shown in FIG. 7C forms a protrusion 88 matching the indentation 76 within the bottom tang 75. When the elbow 17 is assembled, the protrusion 88 is inserted into the indentation 76, securing the bottom hub 81 within the bottom tang 75 and preventing the rotation of the bottom hub 81 with respect to the bottom tang 75. While the protrusion 88 and the indentation 76 are shown to be of a particular shape, other matching shapes of the protrusion 88 and the indentation 76 are possible.

Returning to FIGS. 7A and 7B, the bottom hub 81 further defines a slot 89 that is adjacent to the counterbore 86. The inner surface 85 of the bottom hub 81 also forms a plurality of grooves 90.

Figure 9:
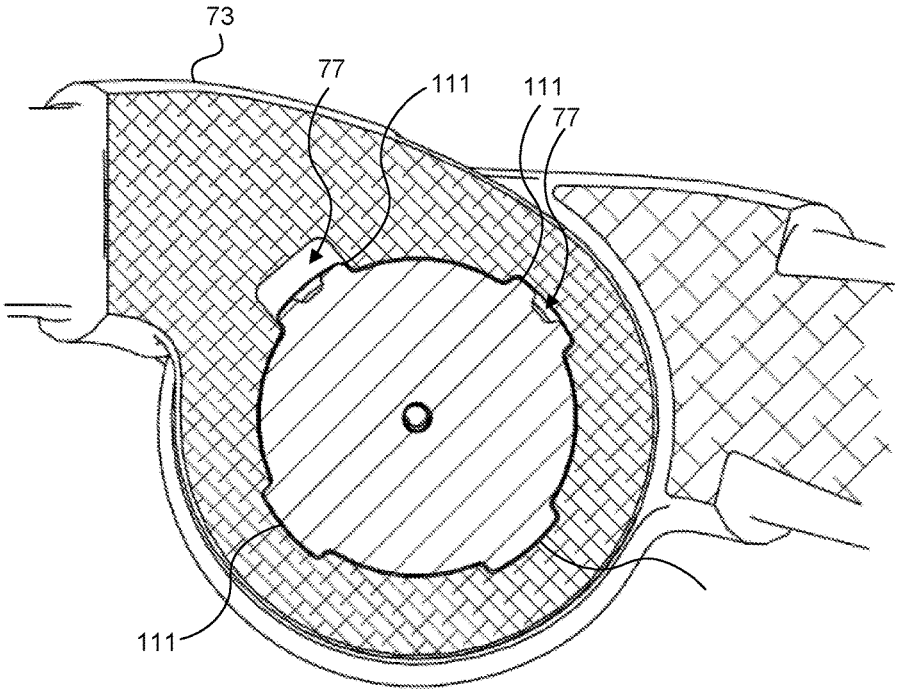
FIG. 9 is a diagram showing a cross-sectional view of the protrusions of the top hub of FIG. 5 within the grooves of the circular bore in accordance with one embodiment.

The top hub 82 inserts into the inner surface 85 of the bottom hub 82 and the circular bore 74 of the top tang 73. FIGS. 8A-8C show several views of the top hub 82 in accordance with one embodiment. The top hub 82 further includes protrusions 111 that match the grooves 77 within the circular bore 74, preventing the rotation on the top hub 82 within the circular bore, as can be seen with reference to FIG. 9. FIG. 9 is a diagram showing a cross-sectional view of the protrusions 111 of the top hub 82 of FIG. 5 within the grooves 77 of the circular bore 74 in accordance with one embodiment.

The top hub 82 further inserts into the bottom hub 81. In particular, the top hub 82 also includes a plurality of protrusions 114 matching the plurality of indentations 90 of the inner surface 85 of the bottom hub 81, preventing the rotation of the top hub 82 within the top hub 81. The top hub 82 further includes a passage 112 from the end 115 of the hub 82 that is secured within the circular bore 74 to the end 116 of the hub 82 that is inserted into the bottom hub 81. A slot 113 is formed within the hub 82 that is adjacent to the passage 112.

Figure 10:
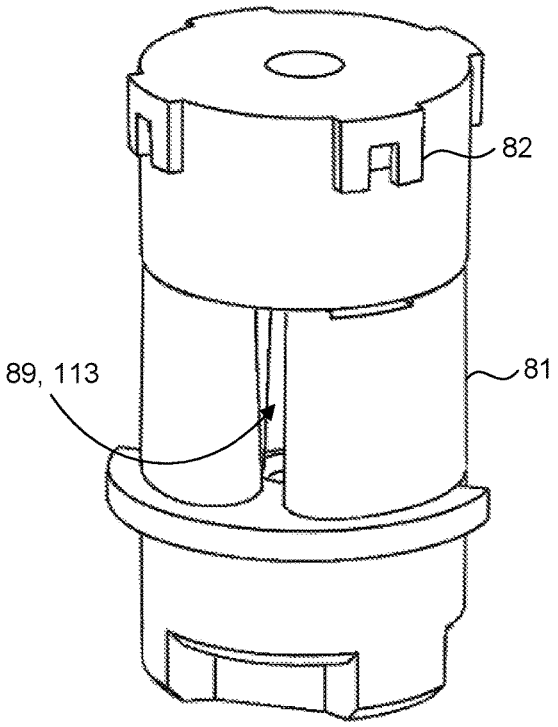
FIG. 10 is a diagram showing the top hub of FIG. 5 inserted into the bottom hub of FIG. 5 in accordance with one embodiment.

FIG. 10 is a diagram showing the top hub 82 of FIG. 5 inserted into the bottom hub 81 of FIG. 5 in accordance with one embodiment. The end 116 of the top hub 82 inserts into the counterbore 86 of the bottom hub 82. As can be seen with reference with FIG. 10, the slot 113 within the top hub 82 aligns with the slot 89, allowing the webbing 50 to pass through both slots 89, 113, as further described below.

Figure 11:
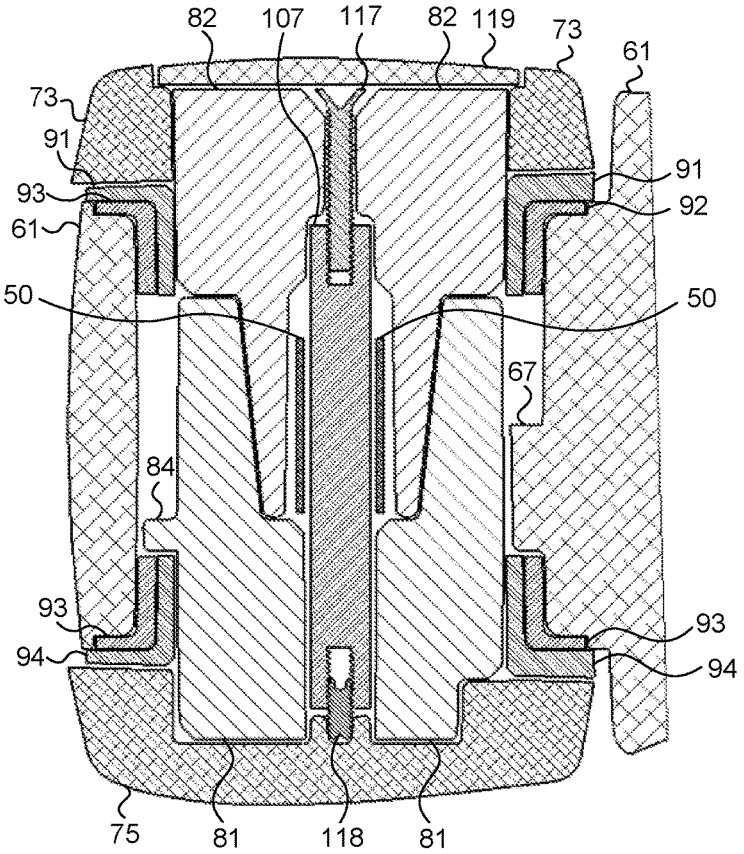
FIG. 11 is a diagram showing a cross-section of the elbow 17 in accordance with one embodiment.
Figure 12:
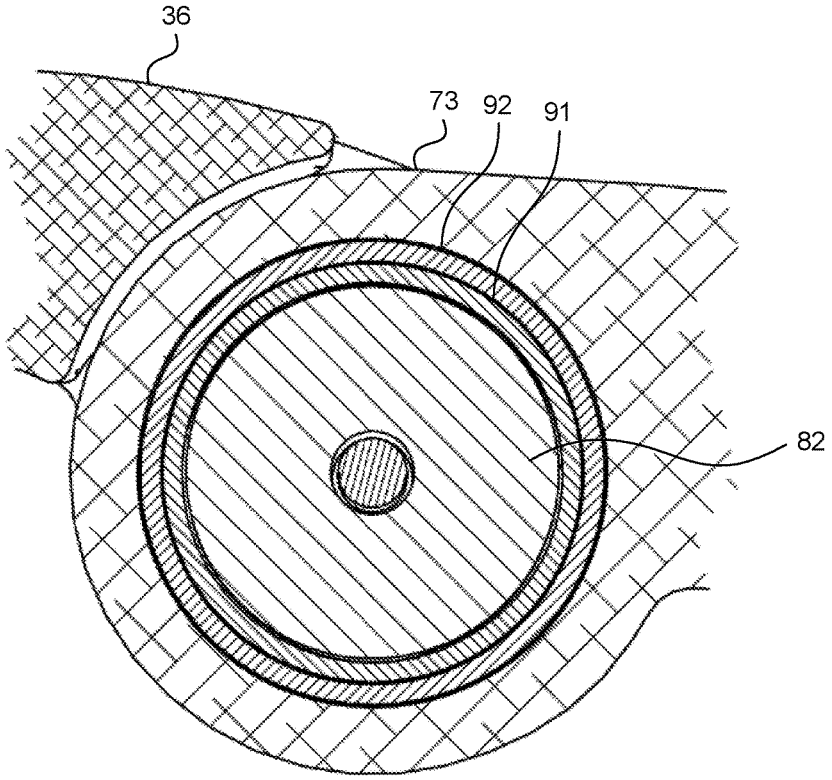
FIG. 12 is a diagram illustrating the positions of the top bushings in an assembled elbow in accordance with one embodiment.

As mentioned above, the bushings 91-94 form a rotational engagement of the inner knuckle 36 to the outer knuckle 37. Returning to FIG. 5, the bushings 91-94 include a top outer bushing 91 that, when the elbow 17 is assembled, as shown below in FIGS. 11 and 12, surrounds a portion of the top hub 82 and is adjacent to the top tang 73. The side of the top outer bushing that is adjacent to the top tang includes a draft complementary to the draft of the top tang 73. A side of the top outer bushing 91 opposite to the side that is adjacent to the top tang is inserted into the top inner bushing 92, with the insertion allowing the bushings 91, 92 to rotate past each other. The side of the top inner bushing 92 that is opposite to the rotatably engaged side is pressed into the top counterbore 64 of the circular encasement 61, remaining stationary with respect to the encasement 61. Similarly, the top outer bushing 91 remains stationary with respect to the top tang 75. FIG. 12 is a diagram illustrating the positions of the top bushing 91, 92 with respect to the top hub 82 in an assembled elbow 17 in accordance with one embodiment. The bushings 93 and 94 are similarly positioned with respect to the bottom hub 81.

Similarly to the bushings 91, 92, the bottom bushings 93, 94 rotatably attach to each other when the elbow 17 is assembled. Thus, the bottom outer bushing 94 surrounds a portion of the bottom hub 81 and one side of the bushing 93 is adjacent to the bottom tang 75. The side of the outer bushing 94 opposite to the side adjacent to the bottom tang 75 is rotatably engaged to a side of the bottom inner bushing 93, which is inserted into the bottom outer bushing 94. The side of the inner bushing 93 opposite to the side rotatably engaged to the bottom outer bushing 93 is pressed into the bottom counterbore 65 of the encasement 61, remaining stationary with respect to the encasement 61. Similarly, the bottom outer bushing 91 remains stationary with respect to the top tang 75.

The lack of rotation of the bushings 91-94 with respect to the tangs 91-94 and to the circular encasement 61 can be accomplished in a variety of ways. For example, the bushings 91 and 94 can include a flat surface (124 as shown on the bushing 91) that is pressed against a flat surface of the support structure 71, preventing the rotation of the outer bushings 91 and 94. Alternatively, the bushings 91 and 94 can include a protrusion (not shown) that can be inserted into an indentation within the support structure 72 to prevent the rotation of the bushing 91. The inner bushings 92 and 93 are rendered immobile with respect to the counterbores 64 and 65 due to a tightness of the fit of the bushings within the counterbores 64, 65.

The bushings 91-94 are rotatably engaged to each other and to other elements of elements of the elbow 17. FIG. 11 is a diagram showing a cross-section of the elbow 17 in accordance with one embodiment. As can be seen with reference to FIG. 11, the outer bushings 91 and 94 directly surround the top hub 82 and the bottom hub 81, respectively. The outer bushings 91 and 94 have surfaces that are adjacent to the top tang 73 and the bottom tang 75 respectively. The inner bushings 92 and 93 in turn surround a portion of the outer bushings 91 and 94 respectively, allowing rotation between the bushings 91 and 92 and bushing 93 and 94 that in turns results in the rotation of the elbow 17 as a whole. The use of the bushings 91-94 allows to avoid metal-on-metal interactions that could cause a premature deterioration of the elbow if the knuckles 36, 37 interacted directly.

As the top hub 82 is securely mounted within the top tang 73 and the bottom hub 82 is securely mounted within the bottom hub 75, a rotation of the structure formed by the top hub 82 being inserted into the bottom hub 81, as shown with reference to FIG. 10, causes the rotation of the entire outer knuckle 37 with respect to the inner knuckle 36. Such rotation can be caused by a force being applied on the arm 16, such by the front bar 15 being pulled towards the torsion bar 14, or by the spring 15 pulling on the webbing 50 secured within the hubs 81, 82, as described further below.

Returning to FIG. 5, the elbow 17 further includes a pin 107 that secures the webbing 50 within the elbow 17. The pin 107 can be a threaded shaft and serves as a keder around which the webbing 50 can loop. As mentioned above, the top hub passage 112 is adjacent to the bottom hub passage 87 when the top hub 82 is inserted into the bottom hub 81, forming one continuous passage from the top end 115 of the top hub 82 to the protrusion 88 of the bottom hub 81 that is inserted into the indentation 76 of the bottom tang 75, as can also be seen with reference to FIG. 11. The pin 107 is inserted into the continuous passage, passing through both the top hub passage 112 and the bottom hub passage 87. The pin 107 is secured within the top hub passage 112 by a machine bolt 117 that is inserted into the top hub passage from the end 115 of the top hub 82 that is secured within the circular bore 74. The pin 107 is secured within the bottom hub passage 87 by a set screw 118 that inserts into the attachment structure 78 of the bottom tang 75 and into the end of the pin 107 within the bottom hub passage 87. Other ways to secure the pin 107 are possible.

Figure 13:
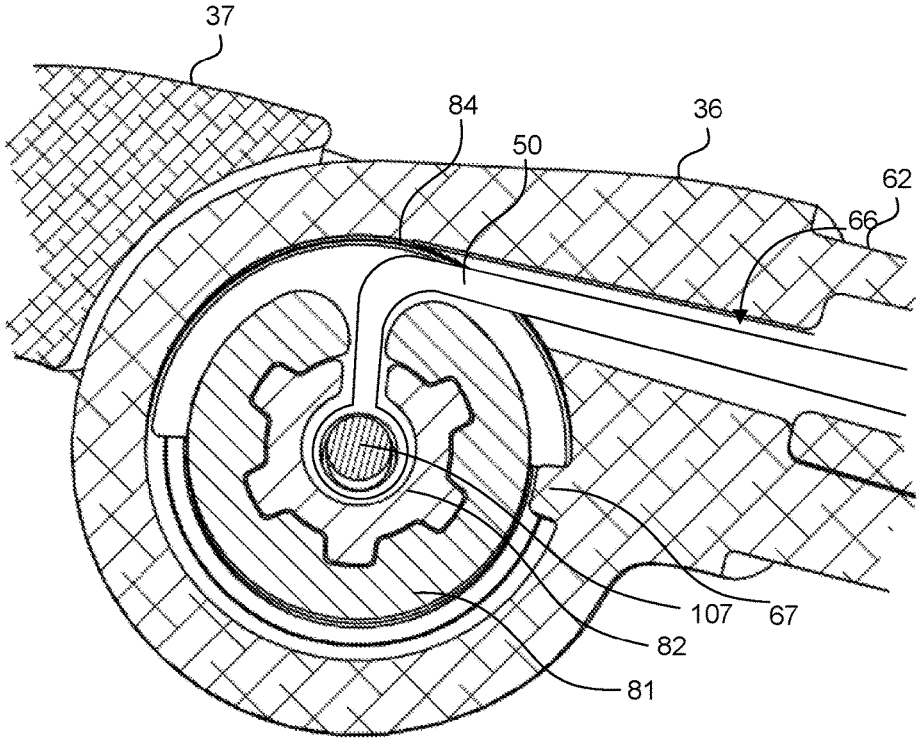
FIG. 13 is a cross-sectional view of the elbow showing the webbing looped around the pin in accordance with one embodiment.

The webbing 50 forms a loop around the pin 107 within the continuous passage and is secured by the pin 107 within the elbow 17. FIG. 13 is a cross-sectional view of the elbow 17 showing the webbing 50 looped around the pin 107 in accordance with one embodiment. As mentioned above, when the elbow 17 is assembled, the slots 89 and 113 within the bottom hub 81 and the top hub 82 are aligned. The webbing 50 is passed through the slots 89,113, though the slot 66 within the circular encasement 61, and into the sleeve 62.

Figure 15:
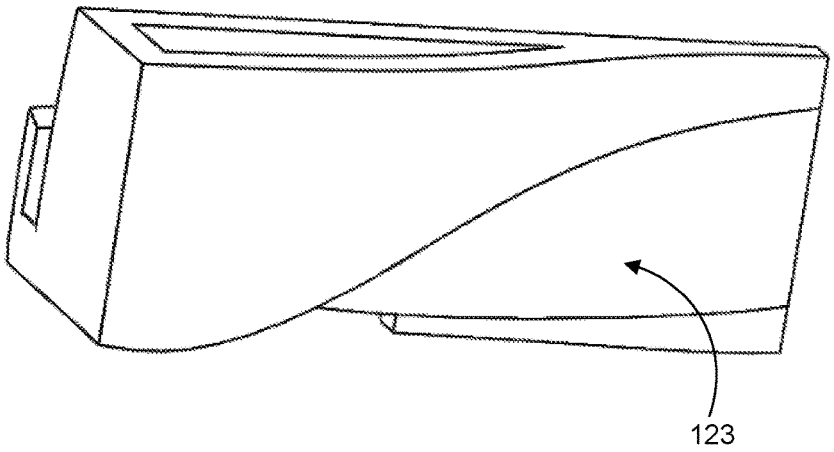
FIG. 15 is a diagram of showing a side of the insert opposite to the side on which the protrusion is formed in accordance with one embodiment.

The orientation of the portion of the webbing 50 looped around the pin passed through the slots 89, 113, and 66 differs from the orientation of the portion of the webbing 50 that is attached to the spring 35 as shown in FIG. 4. The change in the orientation is accomplished using an insert 104 in the inner knuckle sleeve 62. The insert 104 includes a protrusion 106 that is inserted into the slot 102 within the sleeve 62. The insert 104 is secured within the sleeve 62 by a raised ledge 105 that is formed on the protrusion 106 and that is inserted into an indentation 103 formed on the sleeve above the ledge 105. FIG. 15 is a diagram of showing a side of the insert 104 opposite to the side on which the protrusion 106 is formed in accordance with one embodiment. The side of the insert 104 opposite to the side on which the protrusion 106 includes a slide twist 123 against which the webbing 50 is passed. As the webbing 50 passes by the twist 123, the twist forces a change in the orientation of the webbing 50 from being in a horizontal orientation in relation to the sleeve 62 to being in a vertical orientation in relation to the sleeve 62. The change in the orientation of the webbing 50 can also be seen in the shape of the webbing 50 shown with reference to FIG. 3, with the change in the orientation mirroring the shape of the slide twist.

Figure 14:
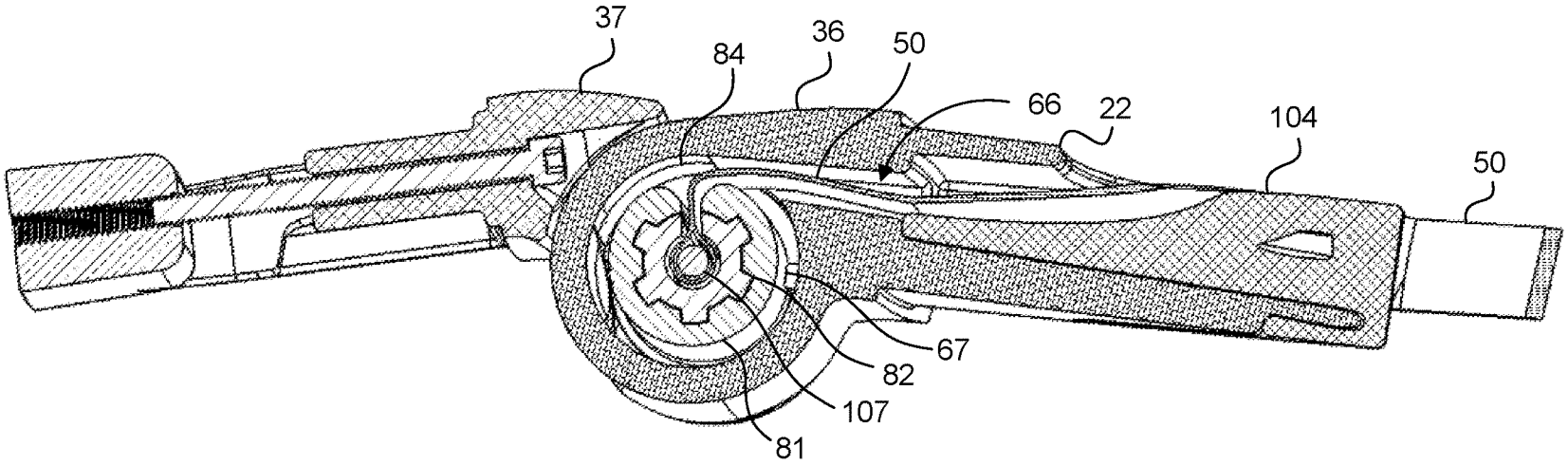
FIG. 14 is a diagram of a cross-section of the arm illustrating a change in the orientation of the webbing in accordance with one embodiment.

FIG. 14 is a diagram of a cross-section of the arm 16 illustrating a change in the orientation of the webbing 50 in accordance with one embodiment. As can be seen with reference to FIG. 14, once the webbing 50 passes through the insert 105, the orientation of the webbing 50, becoming consistent with the orientation of the portion of the webbing 50 that is hooked to the spring 35 described above with reference to FIG. 4.

As can also been seen with reference to FIGS. 13 and 14, the flange 84 limits the rotation of the outer knuckle in relation to the inner knuckle when contacting the protrusion 67 on the inner surface 68 of the circular encasement. The outer knuckle 67 can rotate in two directions with respect to the inner knuckle 36, clockwise and counterclockwise. The protrusion 67 would block the rotation in each direction upon the flange 84 reaching the protrusion 67. While the directions are referred to as clockwise and counterclockwise in the description below, the two directions could also be reversed depending on the orientation of the arms 16.

As described above, a rotation of the roller tube 12 pulls the front bar 15 towards the torsion bar 14. If the pull is stronger than the pull of the spring 35 on the webbing 50, the outer knuckle 37 rotates in the counterclockwise direction, allowing the front bar 15 to move towards the torsion bar 14. During the rotation of the outer knuckle (and consequently, the whole elbow 17) in the counter-clockwise direction, the webbing 50 wraps around a portion the outer surface 83 of the bottom hub 81. Once the pull on the fabric 12 is removed, the pull of the spring 35 causes the wrapped webbing 50 to rotate the outer knuckle 37 in the clockwise direction, thus straightening the arm 16 out.

The protection of the internal parts of the elbow 17 from the elements allows to prolong the lifespan of the elbow. Returning to FIG. 5, the elbow 17 includes a cap 119 whose shape allows the cap 119 to be securely mounted within a portion of the circular bore 74 above the top hub 82. The cap 119 conceals components of the elbow 17 visible through the circular bore 74 from the outside world. While the cap 119 on one of the sides of the cap, in a further embodiment, no drawings are included on the cap 119.

The webbing 50 can be made of a polyurethane, though other materials are possible. The bushings 31-32 and 91-94 can be made of plastic, though other materials are possible. Unless otherwise indicated above, other components of the arm 16 can be made of a metal, such as aluminum, though other materials are also possible.

While the invention has been particularly shown and described as referenced to the embodiments thereof, those skilled in the art will understand that the foregoing and other changes in form and detail may be made therein without departing from the spirit and scope of the invention.

What is claimed is:

1. A joint assembly for use in a retractable awning, comprising:

an inner knuckle comprising a circular encasement and an inner knuckle sleeve one end of which is formed on a portion of the circular encasement, the portion of the encasement defining a slot;

an outer knuckle comprising a support structure, an outer knuckle sleeve one end of which is formed on one side of the support structure, a top tang comprising a circular bore and that is formed on a side of the support structure opposite to the side on which the outer knuckle sleeve is formed, and a bottom tang comprising an indentation and that is formed on the opposite side of the support structure, the top tang rotatably engaged to a top portion of the circular encasement, the bottom tang rotatably engaged to a bottom portion of the circular encasement, the outer knuckle rotatable in two directions along the top portion of the encasement and the bottom portion of the encasement;

a bottom hub partially within the circular encasement and comprising an inner surface and an outer surface, the outer surface comprising an end inserted into the bottom tang indentation, the inner surface comprising a counterbore formed at another end of the bottom hub and a passage from the counterbore to the end of the bottom hub, the bottom hub further defining a slot adjacent to at least a portion of the counterbore;

a top hub partially within the circular encasement, the top hub comprising a bottom portion mounted within the bottom hub counterbore and a top portion mounted within the circular bore, the top hub further comprising a passage that is adjacent to the bottom hub passage and defining a slot that is adjacent to a portion of the top hub passage and to the bottom hub slot;

a pin inserted through at least a portion of the top hub passage and at least a portion of the bottom hub passage; and a webbing looped around at least a portion of the pin and passed through the bottom hub slot, the top hub slot, and the inner knuckle slot into the inner knuckle sleeve, the webbing adapted to wrap around at least a portion of the outer surface of the bottom hub when the outer knuckle rotates in one of the directions, the webbing urging the outer knuckle to rotate into another of the directions upon an application of a pulling force upon the webbing.

2. A joint assembly according to claim 1, further comprising:

a top outer bushing surrounding a portion of the top hub and comprising a side adjacent to the top tang, the top outer bushing comprising a flat surface blocking a rotation of the top outer bushing against the support structure;

a top inner bushing comprising one side rotatably coupled to a side of the top outer bushing opposite to the adjacent side, the top inner bushing comprising another side attached to the top portion of the circular encasement;

a bottom inner bushing surrounding a portion of the outer surface of the bottom hub and comprising one side attached to the bottom portion of the circular encasement; and a bottom outer bushing comprising one side adjacent to the bottom tang, a further flat surface blocking a rotation of the top outer bushing against the support structure, and further comprising a side opposite to the adjacent surface that is rotatably coupled to a side of the bottom inner bushing opposite to the one bottom inner bushing surface.

3. A joint assembly according to claim 2, wherein a surface of the top tang adjacent to the top inner bushing side comprises a draft and the adjacent top inner bushing side comprises a taper complementary to the draft.

4. A joint assembly according to claim 1, further comprising:

an insert set into another end of an upper elbow sleeve opposite to the end formed on the portion of the circular encasement, the insert comprising a twist that causes a change in an orientation of the webbing when the webbing passes through the twist.

5. A joint assembly according to claim 4, further comprising:

a slot formed within the upper elbow sleeve;

an indentation within an outer surface of the upper elbow sleeve adjacent to the upper elbow sleeve slot;

a protrusion formed on the insert that is within the upper elbow sleeve slot; and a raised ledge formed on the protrusion inserted within the upper elbow sleeve indentation.

6. A joint assembly according to claim 1, wherein the pin comprises an internally-threaded shaft, further comprising:

a machine bolt inserted through a portion of the top hub passage and coupled to a top portion of the shaft; and a set screw coupled to a bottom portion of the shaft and the bottom tang.

7. A joint assembly according to claim 1, further comprising:

a passage within the outer knuckle support structure;

a bolt inserted through the outer knuckle support structure passage; and a wedge within the outer knuckle sleeve threaded onto the bolt.

8. A joint assembly according to claim 1, further comprising:

a flange formed on the outer surface of the bottom hub;

a protrusion on a surface of the circular encasement facing the bottom hub blocking the rotation of the outer knuckle in one of the directions upon the bottom hub flange contacting the protrusion.

9. A joint assembly according to claim 1, further comprising:

a cap securely mounted within a further portion of the circular bore adjacent to the portion within which the top hub is mounted.

10. A mechanical joint assembly according to claim 1, further comprising:

a plurality of indentations formed within the circular bore;

a plurality of protrusions formed on the top hub set within the circular bore indentations.

11. A joint assembly according to claim 1, further comprising:

a plurality of grooves within the inner surface of the bottom hub;

a plurality of protrusions formed on the bottom portion of the top hub set within the grooves.

12. An arm assembly according to claim 1, further comprising:

a lower arm member sleeve comprised within the lower arm member.

13. An arm assembly according to claim 12, further comprising:

a passage within the outer knuckle support structure;

a bolt inserted through the outer knuckle support structure passage; and a wedge within the outer knuckle sleeve threaded onto the bolt, wherein the wedged outer knuckle sleeve securely fits within the lower arm member sleeve.

14. A retractable awning arm assembly, comprising:

a shoulder comprising a shoulder extrusion through which a bolt is inserted, the shoulder further comprising a tension hook mounted upon the bolt;

a upper arm extrusion comprising an upper arm sleeve into one end of which the shoulder extrusion is inserted;

a tensioned spring within the upper arm sleeve that is securely attached to the tension hook;

a lower arm member;

an elbow assembly, comprising:

an inner knuckle comprising a circular encasement and an inner knuckle sleeve comprising one end formed on a portion of the circular encasement and another end securely inserted within a lower arm member sleeve, the portion of the encasement defining a slot;

an outer knuckle comprising a support structure, an outer knuckle sleeve one end of which is formed on one side of the support structure, a top tang comprising a circular bore and that is formed on a side of the support structure opposite to the side on which the outer knuckle sleeve is formed, and a bottom tang comprising an indentation and that is formed on the opposite side of the support structure, the top tang rotatably engaged to a top portion of the circular encasement, the bottom tang rotatably engaged to a bottom portion of the circular encasement, the outer knuckle rotatable in two directions along the top portion of the encasement and the bottom portion of the encasement, the rotation of the outer knuckle causing a rotation of the lower arm member;

a bottom hub partially within the circular encasement and comprising an inner surface and an outer surface, the outer surface comprising an end inserted into the bottom tang indentation, the inner surface comprising a counterbore formed at another end of the bottom hub and a passage from the counterbore to the end of the bottom hub, the bottom hub further defining a slot adjacent to at least a portion of the counterbore;

a top hub partially within the circular encasement, the top hub comprising a bottom portion securely mounted within the bottom hub counterbore and a top portion mounted within the circular bore, the top hub further comprising a passage that is adjacent to the bottom hub passage and a defining slot that is adjacent to a portion of the top hub passage and to the bottom hub slot;

a pin inserted through at least a portion of the top hub passage and at least a portion of the bottom hub passage;

a webbing looped around at least a portion of the pin and passed through the bottom hub slot, the top hub slot, the inner knuckle, the inner knuckle slot, the inner knuckle sleeve into the inner upper arm sleeve and coupled to the spring, the webbing adapted to wrap around at least a portion of the outer surface of the bottom hub when the outer knuckle rotates in one of the directions, the tensioned spring adapted to urge the webbing to rotate into another of the directions;

a wrist member securely attached to the lower arm member.

15. A retractable awning, comprising:

a fabric roll comprising fabric partially rolled onto a rotatable roller tube;

a front bar to which a portion of the fabric is attached;

a torsion bar attached to the roller tube;

two arms attached to the torsion bar and the front bar, the arms bendable upon a rotation of the fabric roll pulling the front bar towards the fabric roll, each of the arms comprising:

a shoulder comprising a shoulder extrusion through which a bolt is inserted, the shoulder further comprising a tension hook mounted upon the bolt;

a upper arm extrusion comprising an upper arm sleeve into one end of which the shoulder extrusion is inserted;

a tensioned spring within the upper arm sleeve that is securely attached to the tension hook;

a lower arm member;

a wrist member comprising an end securely attached to the lower arm member and another end attached to the front bar;

an elbow assembly, comprising:

an inner knuckle comprising a circular encasement and an inner knuckle sleeve comprising one end formed on a portion of the circular encasement and another end securely inserted within a lower arm member sleeve, the portion of the encasement defining a slot;

an outer knuckle comprising a support structure, an outer knuckle sleeve one end of which is formed on one side of the support structure, a top tang comprising a circular bore and that is formed on a side of the support structure opposite to the side on which the outer knuckle sleeve is formed, and a bottom tang comprising an indentation and that is formed on the opposite side of the support structure, the top tang rotatably engaged to a top portion of the circular encasement, the bottom tang rotatably engaged to a bottom portion of the circular encasement, the outer knuckle rotatable in two directions along the top portion of the encasement and the bottom portion of the encasement, the rotation of the outer knuckle causing a rotation of the lower arm member;

a bottom hub partially within the circular encasement and comprising an inner surface and an outer surface, the outer surface comprising an end inserted into the bottom tang indentation, the inner surface comprising a counterbore formed at another end of the bottom hub and a passage from the counterbore to the end of the bottom hub, the bottom hub further defining a slot adjacent to at least a portion of the counterbore;

a top hub partially within the circular encasement, the top hub comprising a bottom portion securely mounted within the bottom hub counterbore and a top portion mounted within the circular bore, the top hub further comprising a passage that is adjacent to the bottom hub passage and a slot that is adjacent to a portion of the top hub passage and to the bottom hub slot;

a pin inserted through at least a portion of the top hub passage and at least a portion of the bottom hub passage;

a webbing looped around at least a portion of the pin and passed through the bottom hub slot, the top hub slot, the inner knuckle, the inner knuckle slot, the inner knuckle sleeve into the inner upper arm sleeve and coupled to the spring, the webbing adapted to wrap around at least a portion of the outer surface of the bottom hub when the outer knuckle rotates in one of the directions during the bending of each of the arms, the tensioned spring adapted to urge the webbing to rotate into another of the directions and to urge a straightening of each of the arms.

16. A retractable awning according to claim 15, comprising:

a motor coupled to the rotatable roller tube.

17. A retractable awning according to claim 15, further comprising:

a flange formed on the outer surface of the bottom hub;

a protrusion on a surface of the circular encasement facing the bottom hub blocking the rotation of the outer knuckle in one of the directions upon the bottom hub flange contacting the protrusion.

18. A retractable awning according to claim 15, further comprising:

a lower arm member sleeve comprised within the lower arm member.

19. A retractable awning according to claim 18, further comprising:

a passage within the outer knuckle support structure;

a bolt inserted through the outer knuckle support structure passage; and a wedge within the outer knuckle sleeve threaded onto the bolt, wherein the wedged outer knuckle sleeve securely fits within one end of the lower arm member sleeve.

20. A retractable awning according to claim 19, wherein the end of the wrist member securely fits within another end of the lower arm member sleeve opposite to the end into which the wedged outer knuckle securely fits.

* * * * *